United States Patent [19]

Hinata et al.

[11] 4,002,480

[45] Jan. 11, 1977

[54] PHOTOGRAPHIC SILVER HALIDE EMULSION

[75] Inventors: Masanao Hinata; Yuji Mihara; Reiichi Ohi; Keiichi Adachi; Akira Sato, all of Minami-ashigara, Japan

[73] Assignee: Fuji Photo Film Co., Ltd., Minami-ashigara, Japan

[22] Filed: Mar. 6, 1975

[21] Appl. No.: 555,912

[30] Foreign Application Priority Data

Mar. 7, 1974 Japan ..... 49-26620

[52] U.S. Cl. ..... 96/122; 96/100; 96/139; 96/140

[51] Int. Cl.[2] ..... G03C 1/08

[58] Field of Search ..... 96/122, 126, 139, 140, 96/100

[56] References Cited

UNITED STATES PATENTS

| | | | |
|---|---|---|---|
| 3,416,927 | 12/1968 | Kalenda | 96/122 |
| 3,615,641 | 10/1971 | Shiba et al. | 96/122 |
| 3,617,295 | 11/1971 | Shiba et al. | 96/126 |
| 3,649,288 | 3/1972 | Shiba et al. | 96/122 |
| 3,706,567 | 12/1972 | Hiller | 96/126 |

*Primary Examiner*—J,. Travis Brown
*Attorney, Agent, or Firm*—Sughrue, Rothwell, Mion, Zinn & Macpeak

[57] ABSTRACT

A photographic silver halide emulsion containing at least one dinuclear merocyanine sensitizing dye, and at least one compound represented by the following formula:

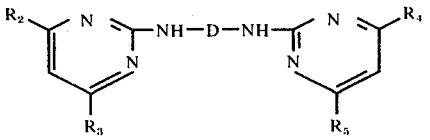

wherein D represents a divalent aromatic group, $R_2$, $R_3$, $R_4$, and $R_5$ each represents a hydrogen atom, a hydroxyl group, an alkoxyl group, an aryloxy group, a halogen atom, a heterocyclic group, a mercapto group, an alkylthio group, an arylthio group, a heterocyclic thio group, an amino group, an alkylamino group, a cycloalkylamino group, an arylamino group, a heterocyclic amino group, an aralkylamino group, or an aryl group.

9 Claims, No Drawings

PHOTOGRAPHIC SILVERHALIDE EMULSION

BACKGROUND OF THE INVENTION

1. Field of the Invention

The present invention relates to a silver halide emulsion and in particular to a photographic silver halide emulsion in which the formation of photographic fog caused by a sensitizing dye is inhibited and the reduction in spectral sensitivity with the lapse of time is prevented.

2. Description of the Prior Art

It is well known that optical sensitization, i.e., a technique for further extending the light-sensitive wavelength range of a photographic silver halide emulsion to longer a wavelength side by adding a certain sensitizing dye to the emulsion, can be employed as a technique for producing a photographic light-sensitive emulsion.

The intensity of the spectral sensitization is influenced by the chemical structure of the sensitizing dye, the properties of the emulsion (such as, for example, the silver halide composition, the silver halide crystal habit and the silver halide crystal system, the silver ion concentration and the hydrogen ion concentration), and the like. Further, the spectral sensitivity is also affected by photographic additives also present in the emulsion, such as stabilizers, anti-foggants, coating aids, precipitating agents, color couplers, and the like.

It is also well known that the addition of a sensitizing dye to a silver halide emulsion results in photographically adverse side effects along with spectral sensitization. Of these adverse effects, the formation of fog caused by the addition of a sensitizing dye (hereinafter, this type of fog will be referred to as "dye fog") and the reduction in spectral sensitivity with the lapse of time greatly hinder the production of a photographic light-sensitive material having sufficient optical sensitivity, reduced fogging, and good storability. In particular, in the case of photographic papers, even the slightest increase in dye fog undesirably reduces the commercial value of the photographic papers to a great extent. When a sensitizing dye is used together with a conventionally employed anti-foggant or stabilizer for improving these drawbacks, the spectral sensitivity is remarkably reduced in some cases and the degradation of spectral sensitivity with the lapse of time may be rather increased. Thus, for obtaining effective results, the above-mentioned additives must be selected strictly in accordance with the sensitizing dye to be employed.

On the other hand, when a dinuclear merocyanine dye is used as a sensitizing dye in a color photographic material, the dye tends to diffuse into other layers, whereby the diffused dye undesirably sensitizes the layer into which it has diffused (hereinafter, this type of sensitization will be referred to as "diffusion sensitization"). For example, on diffusing into a green-sensitive layer and/or a blue-sensitive layer, a merodicarbocyanine dye employed in a red-sensitive layer may panchromatically sensitize these layers, resulting in a production of color staining in the colored images, a reduction of the green sensitivity in the green-sensitive layer, or a reduction of the blue sensitivity in the blue-sensitive layer; on diffusing into a blue-sensitive layer and/or a red-sensitive layer, a merocarbocyanine dye employed in a green-sensitive layer may orthochromatically sensitize this layer, resulting in a color mixing in the colored images, a reduction of the blue sensitivity in the blue sensitive layer, or a reduction in the red sensitivity in the red-sensitive layer; or on diffusing into a green sensitive layer and/or a red-sensitive layer, a simple merocyanine dye may cause a reduction in the green sensitivity in the green-sensitive layer, or a reduction in the red sensitivity in the red-sensitive layer. Diffusion sensitization is a phenomenon that is markedly accelerated when a color light-sensitive material is stored under high humidity conditions. Therefore, in cases where a dinuclear merocyanine dye exhibiting high sensitizing effect is employed, prevention of diffusion sensitization is of practical importance.

SUMMARY OF THE INVENTION

Therefore, an object of the present invention is to provide a photographic silver halide emulsion in which diffusion sensitization is prevented.

Another object of the present invention is to provide a photographic silver halide emulsion in which dye fog is prevented.

Still a further object of the present invention is to provide a photographic silver halide emulsion in which deterioration in optical sensitivity with the lapse of time is reduced.

These objects of the present invention are accomplished with a photographic silver halide emulsion containing at least one dinuclear merocyanine dye in combination with at least one compound represented by the general formula (II)

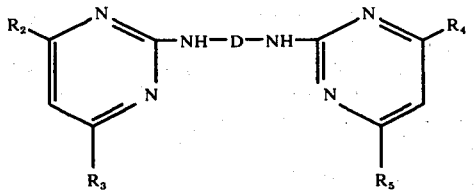

(II)

wherein D represents a divalent aromatic group, $R_2$, $R_3$, $R_4$, and $R_5$, which may be the same or different, each represents a hydrogen atom, a hydroxy group, an alkoxy group, an aryloxy group, a halogen atom, a heterocyclic group, a mercapto group, an alkythio group, an arylthio group, a heterocyclic thio group, an amino group, an alkylamino group, a cycloalkylamino group, an arylamino group, a heterocyclic amino group, an aralkylamino group, or an aryl group.

DETAILED DESCRIPTION OF THE INVENTION

The term "dinuclear merocyanine dye" as used herein designates a merocyanine dye in which the 1-, 2-, 3-, or 4-position of a basic nitrogen-containing heterocyclic nucleus is bonded to the 4-, or 5-position of a 5- or 6-membered ketomethylene heterocyclic nucleus (an acidic nucleus) directly or through a methine group (including a substituted methine group), or a methine chain.

The dinuclear merocyanine dyes which can be employed in this invention include simple merocyanine dyes, merocarbocyanine dyes, merodicarbocyanine dyes, etc., and, in particular, preferred dinuclear merocyanine dyes are those represented by the following general formula (I):

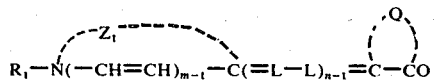

(I)

wherein, $R_1$ represents an aliphatic group (including saturated and unsaturated aliphatic groups, for example, preferably an unsubstituted alkyl group having from 1 to 8 carbon atoms (e.g., a methyl group, an ethyl group, an n-propyl group, an n-butyl group, an n-hexyl group, an n-octyl group, etc.); or a substituted alkyl group [preferably those containing from 1 to 4 carbon atoms in the alkyl moiety, e.g., a vinyl methyl group, a hydroxyalkyl group (e.g., a 2-hydroxyethyl group, a 4-hydroxybutyl group, etc.), an acetoxyalkyl group (e.g., a 2-acetoxyethyl group, a 3-acetoxypropyl group, etc.), an alkoxyalkyl group (e.g., having 1 to 4 carbon atoms in the alkoxy moiety such as a 2-methoxyethyl group, a 4-methoxybutyl group, etc.), a carboxyl-containing alkyl group (e.g., a 2-carboxyethyl group, a 3-carboxypropyl group, a 2-(2-carboxyethoxy)ethyl group, a p-carboxybenzyl group, etc.), a sulfo-containing alkyl group (e.g., a 2-sulfoethyl group, a 3-sulfopropyl group, a 3-sulfobutyl group, a 4-sulfobutyl group, a 2-hydroxy-3-sulfopropyl group, a 2-(3-sulfopropoxy)ethyl group, a 2-acetoxy-3-sulfopropyl group, a 3-methoxy-2-(3-sulfopropoxy)propyl group, a 2-[2-(3-sulfopropoxy)-ethoxy]ethyl group, a 2-hydroxy-3-(3'-sulfopropoxy)propyl group, a p-sulfophenethyl group, a p-sulfobenzyl group, etc.)]; L represents a methine group (including a substituted methine group e.g., those methine groups substituted with an alkyl group (including substituted alkyl group), an acetyl group, an alkoxy group, an alkoxy alkyl group, an alkylthio group, an aryl group, etc.) e.g., —CH=, —C($CH_3$)=, —C($C_2H_5$)=, —C($CH_2CH_2COOH$)=, —C($CH_2CH_2CH_2OH$)=, —C($CH_2CH_2CH_3$)=, —C($COCH_3$)=, —C($OC_2H_5$)=, —C($SC_2H_5$)=,

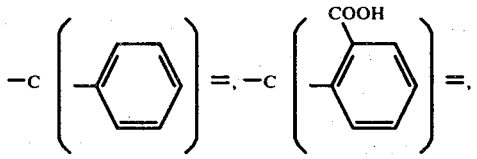

etc., wherein not more than one L can be a substituted methine group; *m* represent 1 or 2, *n* represents 1, 2, or 3; $Z_1$ represents the nonmetallic atoms necessary to complete a 5- or 6-membered heterocyclic nucleus, which may be substituted with an atom or a group such as an alkyl group having from 1 to 4 carbon atoms such as a methyl group, an ethyl group, a propyl group or a butyl group, a monoaryl group such as a phenyl group, a halogen atom such as a chlorine atom, a bromine atom, a fluorine atom or an iodine atom, an alkoxy group having from 1 to 4 carbon atoms such as a methoxy group, an ethoxy group, a propoxy group, or a butoxy group, a carboxy group, a monoaralkyl group such as a benzyl group or a phenethyl group, a trifluoromethyl group, a hydroxy group, an alkoxycarbonyl group (containing from 1 to 4 carbon atoms in the alkyl moiety such as a methoxycarbonyl group, an ethoxycarbonyl group, a propoxycarbonyl group, etc.), or a cyano group, and which may be condensed with a saturated or unsaturated aliphatic hydrocarbon group, for example, a tetramethylene group, etc., in the form of a six-membered ring; and Q represents the nonmetallic atoms necessary to complete a 5-membered heterocyclic nucleus, which may have one or more substituent groups such as an alkyl group (e.g., a methyl group, an ethyl group, a propyl group, a butyl group, a hexyl group, etc.), an alkenyl group (e.g., an allyl group, etc.), an aryl group (e.g., a phenyl group, a halophenyl group, a naphthyl group, etc.), a cycloalkyl group (e.g., a cyclohexyl group, etc.), an aralkyl group (e.g., a benzyl group, etc.), a carboxyalkyl group (e.g., a carboxymethyl group, a carboxyethyl group, a carboxybutyl group, etc.), a sulfoalkyl group (e.g., a sulfomethyl group, a sulfoethyl group, a sulfopropyl group, a sulfobutyl group, etc.), a hydroxyalkyl group (e.g., a hydroxyethyl group, a hydroxypropyl group, a hydroxybutyl group, etc.), etc.

The heterocyclic nuclei formed by $Z_1$ defined above include, for example, a thiazole nucleus (e.g., thiazole, 4-methylthiazole, 4-phenylthiazole, 4,5-dimethylthiazole, 4,5-diphenylthiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, 5-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]-thiazole, 8-methoxynaphtho[2,1-d]thiazole, 5-methoxy[2,3-d]-thiazole, etc.), a thiazoline nucleus (e.g., thiazoline, 4-methylthiazoline, etc.), a oxazole nucleus (e.g., oxazole, 4-methyloxazole, 4-ethyloxazole, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[1,2-d]oxazole, naphtho[2,3-d]oxazole, etc.), a selenazole nucleus (e.g., 4-methylselenazole, 4-phenylselenazole, benzoselenazole, 5chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.), a 3,3-dialkylindolenine nucleus (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.), an imidazole nucleus (e.g., imidazole nuclei substituted at the 1-position with a substituent such as an alkyl group, an aryl group, an allyl group, an acetoxy group, a hydroxyalkyl group, a carboxyalkyl group, etc., such as 1-methylimidazole, 1-ethylimidazole, 1-methyl-4-phenylimidazole, 1-ethyl-4-phenylimidazole, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifluoromethylbenzimidazole, 1-ethylnaphtho[1,2-d]imidazole, 1-allyl-5,6-dichlorobenzimidazole, 1-allyl-5-chlorobenzimidazole, 1-phenylimidazole, 1-phenylbenzimidazole, 1-phenyl-5-chlorobenzimidazole, 1-phenyl-5,6-dichlorobenzimidazole, 1-phenyl-5-methoxybenzimidazole, 1-phenyl-5-cyanobenzimidazole, 1-phenylnaphtho[1,2-d]imidazole, etc.), a tetrazole nucleus (e.g., a 1,3-dimethyltetrazole nucleus, a 1-methyl-3-ethyltetrazole nucleus, etc.), a pyridine nucleus (e.g., pyridine, 5-methyl-2-pyridine, 3-methyl-4-pyridine, etc.), a quinoline nucleus (e.g., quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 6-ethoxy-4-quinoline, 8-chloro-4-quinoline, 8-fluoro-4-quinoline, 8-methyl-4-quinoline, 8-methoxy-4-quinoline, isoquinoline, 3,4-dihydro-1-isoquinoline, etc.), and the like.

The heterocyclic nuclei formed by Q defined above include, for example, a rhodanine nucleus [e.g., 3-ethylrhodanine, 3-allylrhodanine, 3-carboxymethylrhodanine, 3-(2-carboxyethyl)rhodanine, 3-(4-carboxybutyl)rhodanine, 3-(2-sulfoethyl)rhodanine, 3-(3-sulfopropyl)rhodanine, 3-(4-sulfobutyl)rhodanine, 3-phenylrhodanine, 3-benzylrhodanine, 3-cyclohexylrhodanine, 3-(p-chlorophenyl)rhodanine, etc.], a 2-thio-2,4-imidazolidinedione nucleus [e.g., 2-thio-2,4-imidazolidinedione, 3-ethyl-2-thio-2,4-imidazolidinedione, 3-(4-sulfobutyl)-2-thio-2,4-imidazolidinedione, 3-(2-carboxyethyl)-2-thio-2,4-imidazolidinedione, 3-phenyl-2-thio-2,4-imidazolidinedione, 3-α-naphthyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-α-naphthyl-2-thio-2,4-imidazolidinedione, 1,3-diphenyl-2-thio-2,4-imidazolidinedione, 1-(2-carboxylethyl)-3-phenyl-2-thio-2,4-imidazolidinedione, 1-phenyl-3-ethyl-2-thio-2,4-imidazolidinedione, 1-(2-hydroxyethyl)-3-phenyl-2-thio-2,4-imidazolidinedione, 1-(3-hydroxypropyl)-3-phenyl-2-thio-2,4-imidazolidinedione, 1-(2-carboxyethyl)-3-(p-chlorophenyl)-2-thio-2,4-imidazolidinedione, 1-ethyl-3-n-butyl-2-thio-2,4-imidazolidinedione, etc.], a 2-thio-2,4-oxazolidinedione nucleus [e.g., 3-ethyl-2-thio-2,4-oxazolidinedione, 3-(2-sulfoethyl)-2-thio-2,4-oxazolidinedione, 3-(4-sulfobutyl)-2-thio-2,4-oxazolidinedione, 3-(3-carboxypropyl)-2-thio-2,4-oxazolidinedione, 3-(2-hydroxyethyl)-2-thio-2,4-oxazolidinedione, 3-carboxymethyl-2-thio-2,4-oxazolidinedione, 3-phenyl-2-thio-2,4-oxazolidinedione, 3-hexyl-2-thio-2,4-oxazolidinedione, etc.], and a barbituric acid nucleus [e.g., a thio barbituric acid nuclei having a 1-alkyl group such as a 1-methyl group, a 1-ethyl group, a 1-propyl group, a 1-heptyl group, etc.; a 1,3-dialkyl group such as a 1,3-dimethyl group, a 1,3-diethyl group, a 1,3-dipropyl group, a 1,3-diisopropyl group, a 1,3-dicyclohexyl group, a 1,3-di(β-methoxyethyl) group, etc.; a 1,3-diaryl group such as a 1,3-diphenyl group, a 1,3-di-(p-chlorophenyl) group, a 1,3-di(p-ethoxycarbonylphenyl) group, etc.; a 1-sulfoalkyl group such as a 1-(2-sulfoethyl) group, a 1-(3-sulfopropyl) group, a 1-(4-sulfoheptyl) group, etc.; a 1,3-disulfoalkyl group such as a 1,3-di(2-sulfoethyl) group, a 1,3-di(3-sulfopropyl) group, a 1,3-di(4-sulfocyclohexyl) group, etc.; a 1,3-disulfoaryl group such as a 1,3-di(4-sulfophenyl) group, etc.; a 1-sulfoaryl group such as a 1-(4-sulfophenyl) group, etc.].

Of the dinuclear merocyanine dyes which can be employed in this invention, especially preferable dyes are represented by the following general formula (Ia):

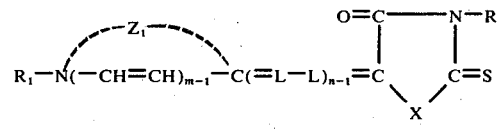

(Ia)

wherein X represents a sulfur atom, an oxygen atom or a >N—R′ group [wherein R′ represents an alkyl group (including both unsubstituted and substituted alkyl groups), preferably an unsubstituted alkyl group containing from 1 to 8 carbon atoms (e.g., a methyl group, an ethyl group, an n-propyl group, an n-butyl group, an octyl group, etc.), a sulfoalkyl group (e.g., a sulfoethyl group, a sulfopropyl group, a sulfobutyl group, etc.), a sulfatoalkyl group (e.g., a sulfatopropyl group, a sulfatobutyl group, etc.), a carboxyalkyl group (e.g., a carboxymethyl group, a carboxyethyl group, a carboxybutyl group, etc.), or a hydroxyalkyl group (e.g., a hydroxyethyl group, a hydroxypropyl group, etc.); or an aryl group (including both unsubstituted and substituted aryl groups), for example, a phenyl group, a sulfophenyl group, a carboxyphenyl group, a tolyl group, etc.]; R has the same meaning as $R_1$; and $R_1$, $Z_1$, $m$, $n$, and L are as defined in the general formula (I) above.

Of the dinuclear merocyanine dyes employed in this invention, still further preferred dyes are represented by the following general formula (Ib):

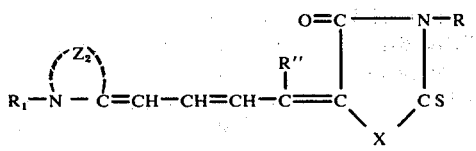

(Ib)

wherein $Z_2$ represents the nonmetallic atoms necessary to complete a thiazole nucleus, or a selenazole nucleus; R″ represents a hydrogen atom; an alkyl group (including both unsubstituted and substituted alkyl groups), preferably an unsubstituted alkyl group containing from 1 to 4 carbon atoms (e.g., a methyl group, an ethyl group, an n-propyl group, etc.), a carboxyalkyl group (e.g., a carboxyethyl group, a carboxypropyl group, etc.), a hydroxyalkyl group (e.g., a hydroxyethyl group, a hydroxypropyl group, etc.), and the like; or an aryl group (including both unsubstituted and substituted aryl groups), for example, a phenyl group, a tolyl group, a naphthyl group, a carboxyphenyl group, etc.; and $R_1$, R, and X are as defined in the general formula (Ia) above.

The dyes used in this invention can be prepared using techniques as described in U.S. Pat. Nos. 2,493,747; 2,493,748; and the like.

Representative examples of dyes which can be employed in this invention include the following dyes:

(1) 3-Carboxymethyl-5-[(3-ethyl-2-benzoxazolinylidene)ethylidene]rhodanine (2) 3-Carboxymethyl-5-[(3-ethyl-2-benzothiazolinylidene)ethylidene]rhodanine (3) 3-Carboxymethyl-5-[(3-methyl-2-thiazolidinylidene)-1-methylethylidene]rhodanine (4) 5-[(3-Methyl-2-thiazolidinylidene)-1-methylethylidene]-3-(2-sulfoethyl)rhodanine (5) 5-[(3-Ethyl-4,5-diethyl-thiazolinylidene)-1-(2-carboxyphenyl)ethylidene]-3-allylrhodanine (6) 5-[(3-Ethyl-2-thiazolidinylidene)-1-(2-carboxyphenyl)ethylidene]-3-phenylrhodanine (7) 5-{[3-(3-Sulfopropyl)-2-thiazolidinylidene]ethylidene}-3-ethylrhodanine potassium salt (8) 3-Ethyl-5-[(3-ethyl-2-benzothiazolinylidene)-1-(2-carboxyethyl)ethylidene]rhodanine (9) 3-Ethyl-5-[(3-ethyl-2-benzothiazolinylidene)-1-(3-hydroxypropyl)ethylidene]rhodanine

(10) 3-Hexyl-5-[(3-ethyl-2-thiazolidinylidene)-1-(2-carboxyphenyl)ethylidene]rhodanine

(11) 3-Carboxymethyl-5-[(3-ethyl-2-benzoxazolinylidene)ethylidene]-2-thio-2,4-oxazolidinedione

(12) 1-Carboxymethyl-5-[(3-ethyl-2benzoxazolinylidene)ethylidene]-3-phenyl-2-thiohydantoin

(13) 1-Ethyl-5-{[3-(3-sulfopropyl)-2-benzoxazolinydene]ethylidene}-3-ethyl-2-thiohydantoin sodium salt

(14) 4-[(3-Ethylnaphtho[1,2-d]thiazolin-2-ylidene)-1-methylethylidene]-3-methyl-1-(4-sulfophenyl)-2-pyrazoline-5-one

(15) 5-[4-(Ethylnaphtho[2,1-d]thiazolin-2-ylidene)-2-butenylidene]-3-ethyl-2-thio-2,4-oxazolidinedione

(16) 5-[4-(3-Ethyl-2-benzoxazolinydene)-2-butenylidene]-1,3-diphenyl-2-thiohydantoin

(17) 3-Ethyl-5-[4-(3-ethyl-2-benzothiazolinylidene)-2-butenylidene]rhodanine

(18) 3-Ethyl-5-[4-(3-methyl-2-thiazolinylidene)-2-butenylidene]-rhodanine

(19) 3-Ethyl-5-[4-(1,3,3-trimethyl-2-indolinylidene)-1-methyl-2-butenylidene]rhodanine

(20) 3-Ethyl-5-[4-(3-ethyl-2-benzothiazolinylidene)-3-methyl-2-butenylidene]rhodanine

(21) 3-Ethyl-5-[4-(3-ethyl-2-benzothiazolinylidene)-1-ethoxy-2-butenylidene]rhodanine

(22) 3-Ethoxycarbonylmethyl-5-[4-(3-ethyl-2-benzothiazolinylidene)-1-acetyl-2-butenylidene]rhodanine

(23) 3-Ethoxycarbonylmethyl-5-[4-(3-ethyl-2-benzothiazolinylidene)-1-ethylthio-2-butenylidene]rhodanine

(24) 3-Ethyl-5-[4-(1-ethyl-2-(1H)-quinolilidene)-3-methyl-2-butenylidene]rhodanine

(25) 5-[4-(3-Ethyl-2-naphtho[2,1-d]thiazolin-2-ylidene)-2-butenylidene]-3-heptyl-1-phenyl-2-thiohydantoin

(26) 3-Carboxymethyl-5-[(3-ethylnaphtho[2,3-d]thiazolin-2-ylidene)-1-methyl-2-butenylidene]rhodanine

(27) 3-Phenyl-1-carboxymethyl-5-[(ethylnaphtho[2,3-d]thiazolin-2-ylidene)-1-phenyl-2-butenylidene]-2-thiohydantoin

(28) 1,3-Diethyl-5-{[3-(3-sulfopropyl)naphtho[2,3-d]thiazolin-2-ylidene]-1-phenyl-2-butenylidene}-2-thiohydantoin sodium salt

(29) 3-Ethyl-5-{[3-(3-sulfopropyl)naphtho[2,3-d]thiazolin-2-ylidene]-1-ethyl-2-butenylidene}rhodanine sodium salt

(30) 3-(2-Sulfoethyl)-5-[(3-ethylnaphtho[2,3-d]thiazolin-2-ylidene)-1-methyl-2-butenylidene]rhodanine Of these dyes, Dyes 17, 20, 27, 28, 29 and 30 are particularly preferred.

The compounds that have general formula (II) indicated above refers to those represented by the following formula:

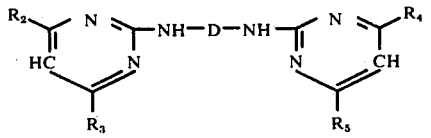

(II)

wherein —D— represents a divalent aromatic group (e.g., a divalent residue of a single aromatic nucleus, a divalent residue in which at least two aromatic nuclei are fused, or a divalent residue in which at least two aromatic nuclei are bonded together directly or through an atom, or an atomic group; such as biphenyl, naphthylene, stilbene, dibenzyl, etc.), particularly those divalent residues represented by $—D_1—$, or $—D_2—$:

$—D_1—$:

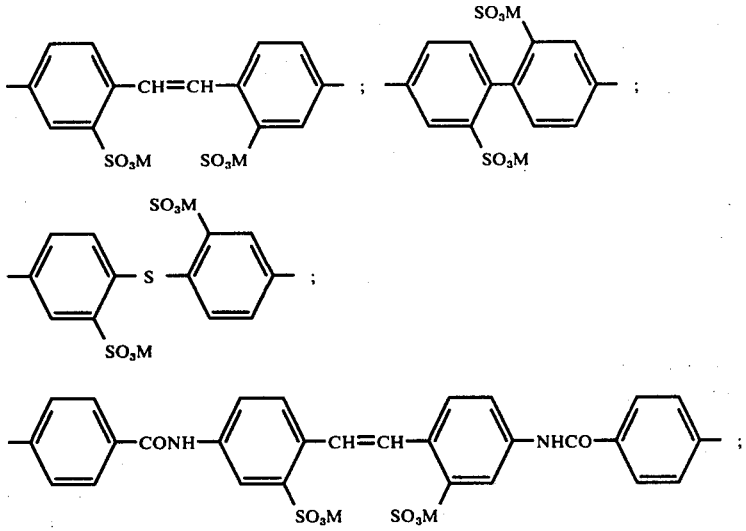

-continued

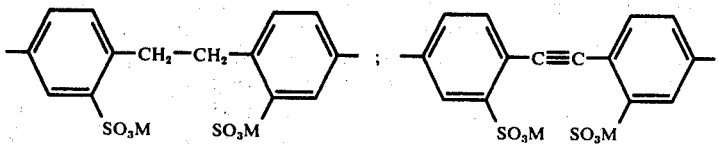

wherein M represents a hydrogen atom, or a cation capable of rendering the molecule water soluble (e.g., an alkali metal ion, such as Na, K, etc., or an ammonium ion);

— $D_2$ —:

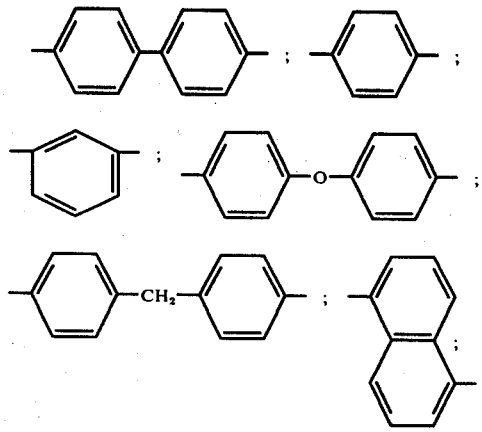

$R_2$, $R_3$, $R_4$, and $R_5$, which may be the same or different, each represents a hydrogen atom, a hydroxy group, an alkoxy group (e.g., a methoxy group, an ethoxy group, etc.), an aryloxy group (e.g., a phenoxy group, a naphthoxy group, an o-toloxy group, a p-sulfophenoxy group, etc.), a halogen atom (e.g., a chlorine atom, a bromine atom, etc.), a heterocyclic group (e.g., a morpholinyl group, a piperidyl group, etc.), a mercapto group, an alkylthio group (e.g., a methylthio group, an ethylthio group, etc.), an arylthio group (e.g., a phenylthio group, a tolylthio group, etc.), a heterocyclic thio group (e.g., a benzothiazoylthio group, a benzoimidazoylthio group, etc.), an amino group, an alkylamino group (e.g., a methylamino group, an ethylamino group, a propylamino group, a dimethylamino group, a diethylamino group, a dodecylamino group, a $\beta$-hydroxyethylamino group, a di-$\beta$-hydroxyethylamino group, a $\beta$-sulfoethylamino group, etc.), a cycloalkylamino group (e.g., a cyclohexylamino group, etc.), an arylamino group (e.g., an anilino group, an o-, m-, or p-sulfoanilino group, an o-, m-, or p-chloroanilino group, an o-, m-, or p-anisidino group, an o-, m-, or p-toluidino group, an o-, m-, or p-carboxyanilino group, a hydroxyanilino group, a sulfonaphthylamino group, an o-, m-, or p-aminoanilino group, an o-acetamidoanilino, etc.), a heterocyclic amino group (e.g., a 2-benzothiazolylamino group, a 2-pyridylamino group, etc.), an aryl group (e.g., a phenyl group), or an aralkylamino group (e.g., a benzylamino group), and when —D— is —$D_2$— as defined above, at least one of $R_2$, $R_3$, $R_4$, or $R_5$ has a substituent containing a —$SO_3M$ group (wherein M is as defined above). A suitable carbon chain length range for the alkyl and alkoxymoieties of the groups described above for $R_1$ to $R_5$ ranges from 1 to 8 carbon atoms.

Typical examples of the compounds represented by the general formula (II), include the following compounds:

(1) Disodium 4,4'-bis[4,6-Di(benzothiazolyl-2-thio)-pyrimidin-2-ylamino]stilbene-2,2'-disulfonate (2) Disodium 4,4'-bis[4,6-Di(benzothiazolyl-2-amino)pyrimidin-2-ylamino]stilbene-2,2'-disulfonate (3) Disodium 4,4'-bis[4,6-Di(1-phenyltetrazolyl-5-thio)-pyrimidin-2-ylamino]stilbene-2,2'-disulfonate (4) Disodium 4,4'-bis[4,6-Di(benzoimidazolyl-2-thio)pyrimidin-2-ylamino]stilbene-2,2'-disulfonate (5) Disodium 4,4'-bis[4-Chloro-6-(2-naphthyloxy)-pyrimidin-2-ylamino]biphenyl-2,2'-disulfonate (6) Disodium 4,4'-bis[4,6-di(naphthyl-2-oxy)pyrimidin-2-ylamino]stilbene-2,2'-disulfonate (7) Disodium 4,4'-bis[4,6-Di(naphthyl-2-oxy)-pyrimidin-2-ylamino]dibenzyl-2,2'-disulfonate (8) Disodium 4,4'-bis(4,6-Diphenoxypyrimidin-2-ylamino)-stilbene-2,2'-disulfonate (9) Disodium 4,4'-bis(4,6-Diphenylthiopyrimidin-2-ylamino)-stylbene-2,2'-disulfonate

(10) 4,4'-bis[4,6-Dichloropyrimidin-2-ylamino]stilbene-2,2'-disulfonic Acid

(11) Disodium 4,4'-bis(4,6-Dianilinopyrimidin-2-ylamino)-stilbene-2,2'-disulfonate

(12) Disodium 4,4'-bis(4,5,6-Trichloropyrimidin-2-ylamino)-stilbene-2,2'-disulfonate

(13) Disodium 4,4'-bis(4,6-Dimercaptopyrimidin-2-ylamino)-biphenyl-2,2'-disulfonate Of these compounds, Compounds 1, 2, 4, 6, 7, and 8 are particularly preferred.

The compounds represented by general formula (II) which are used in accordance with this invention can be easily prepared according to the techniques as described in U.S. Pat. No. 3,617,295.

The combination of the dinuclear merocyanine dye and the compound represented by the general formula (II) in this invention can be employed over a broad range to prevent effectively dye fog, deterioration in sensitivity during storage, and diffusion sensitization. The dinuclear merocyanine dyes employed in this invention can be advantageously used in conventional spectral sensitization amounts, for example, of from about $2 \times 10^{-5}$ to about $2 \times 10^{-3}$ mol per mol of silver halide in an emulsion. The compounds represented by general formula (II) can be advantageously used in an amount of about 0.01 to about 5g per mole of silver halide in an emulsion. A preferred weight ratio of the dinuclear merocyanine dye to the compound represented by the general formula (II) (weight ratio of merocyanine dye compound of general formula (II)) ranges from about 0.5:1 to 0.005:1, particularly from 0.2:1 to 0.01:1.

The sensitizing dyes and the compounds represented by general formula (II) can be added to photographic silver halide emulsions according to conventional techniques which are employed for the addition of sensitizing dyes. They can be directly dispersed into the emulsion, or they can be initially dissolved in a suitable solvent (e.g., methyl alcohol, ethyl alcohol, methyl cellosolve, acetone, water, pyridine, or mixtures thereof), and then added to the emulsion in the form of a solution. Ultrasonic vibration techniques can be used in their dissolution. In addition, the dyes can be incorporated into an emulsion using a method comprising initially dissolving the dyes in a volatile organic solvent, dispersing the resulting solution in a hydrophillic colloid, and then adding the dispersion thus formed into an emulsion, as described in U.S. Pat. No. 3,469,978; or using the method comprising dispersing water-insoluble dyes into a water-soluble solvent without dissolving the dyes, and then incorporating the resulting dispersion into an emulsion, as described in Japanese Patent Publication No. 24185/71, and the like.

The compounds represented by general formula (II) can also be added to an emulsion in the form of a dispersion which can be obtained using the acid dissolving-dispersing method, as described in Japanese Patent Application (OPI) No. 127521/73.

In addition, they can be added to an emulsion using the methods as described in U.S. Pat. Nos. 2,912,345; 3,342,605; 2,996,287; 3,425,835; and the like.

The dinuclear merocyanine dyes and the compounds of the general formula (II) can also be separately added to an emulsion, or in the form of a mixture thereof. They can be uniformly dispersed into a finished emulsion before the emulsion is coated on a suitable support. Of course, they can also be dispersed in an emulsion at any step in the production of the emulsion.

The silver halide to be used in this invention can be a silver halide such as silver chloride, silver bromide, silver iodine, silver chlorobromide, silver iodobromide, and silver chloroiodobromide.

In the silver halide emulsions of this invention, gelatin is ordinarily used as a vehicle of the emulsions; however, other materials which do not adversely affect the light-sensitive silver halide, for example, gelatin derivatives such as an acylated gelatin, albumin, agar-agar, gum arabic, alginic acid, synthetic hydrophilic resins such as polyvinyl alcohol, polyvinyl pyrrolidone, etc., or cellulose derivatives can also be used in place of the gelatin.

The emulsions used in this invention can be coarse grain silver halide emulsions, fine grain silver halide emulsions, or mixtures thereof. The silver halide grains can be prepared using any of the known methods, for example, a single jet method, a double jet method, or a controlled double jet method.

The silver halide grains used in this invention can have crystal structures of the type in which the crystal structure of the silver halide grains is uniform throughout the grains, of the layered type in which the crystal structure of the inner part of the grains is different from that of the outer part, or of the so-called conversion type as described in British Patent No. 635,841 and U.S. Pat. No. 3,622,318. The silver halide grains can also be the grains of the type which form latent images predominantly on the surface of the silver halide grains, or of the type which form latent images predominantly in the interior of the silver halide grains. These photographic emulsions can be prepared by a variety of known methods such as an ammonia method, a neutral method, an acid method, etc., as described in C. E. K. Mees and T. H. James, *The Theory of the Photographic Process*, 3rd Ed. MacMillan, New York (1966), or P. Grafikides, *Photographic Chemistry*, Fountain Press. After the formation of silver halide grains, the emulsions can be washed in order to remove the by-produced water-soluble salts (e.g., potassium nitrate when the silver halide grains are formed from silver nitrate and potassium bromide), and then subjected to a thermal ripening in the presence of a sensitizing agent in order to increase the sensitivity without coarsening the grains. The emulsions can also be used without removing the by-produced soluble salts. These general procedures are also described in Mees and James, supra., and Glafikides, supra.

The mean diameter of the silver halide grains used in this invention preferably ranges from about 0.04 $\mu$ to about 2 $\mu$ (as a number-average value determined, for example, by the projected area method).

The photographic silver halide emulsions used in this invention can be chemically sensitized using conventional chemical sensitization methods, for example, gold sensitization (such as is described in U.S. Pat. Nos. 2,540,085; 2,597,876; 2,597,915; 2,399,083; and the like), sensitization using group VIII metal ions, sulfur sensitization (such as is described in U.S. Pat. Nos. 1,574,944; 2,278,947; 2,440,206; 2,410,689; 3,189,458; 3,415,649; and the like), reduction sensitization (such as is described in U.S. Pat. Nos. 2,518,698; 2,419,974; 2,983,610; and the like), or a combination of these sensitizing methods.

Examples of suitable chemical sensitizers which can be used in this invention include sulfur sensitizers such as allyl thiocarbamide, thiourea, sodium thiosulfate, cystine, etc.; noble metal sensitizers such as potassium chloroaurate, aurous thiosulfate, potassium chloro palladate, etc.; and reduction sensitizers such as stannous chloride, phenylhydrazine, reductones, etc. Other sensitizers such as polyoxyethylene derivatives as described in British Patent No. 981,470; Japanese Patent Publication No. 6475/56; U.S. Pat. No. 2,716,062; etc.; polyoxypropylene derivatives; and quaternary ammonium derivatives can also be employed.

The silver halide emulsions used in this invention can contain suitable antifoggants and stabilizers, such as the thiazolium salts as described in U.S. Pat. Nos. 2,131,038; 2,694,716; and the like; the azaindenes as described in U.S. Pat. Nos. 2,886,437; 2,444,605; and the like; the urazoles as described in U.S. Pat. No. 3,287,135; and the like; the sulfocatecols as described in U.S. Pat. No. 3,236,652; and the like; the oximes as described in British Patent No. 623,448; and the like; the mercaptotetrazoles as described in U.S. Pat. Nos. 2,403,927; 3,266,897; 3,397,987; and the like; nitrons; nitroimidazoles; the polyvalent metal salts as described in U.S. Pat. No. 2,839,405; and the like; the thiuronium salts as described in U.S. Pat. No. 3,220,839; and the like; and the salts of palladium, platinum, and gold as described in U.S. Pat. Nos. 2,566,263; 2,597,915; and the like.

The photographic silver halide emulsions of this invention can contain developers, for example, hydroquinones, catecols, aminophenols, 3-pyrazolidones, ascorbic acid or the derivatives thereof, reductones, phenylenediamines, or combinations of these developers. The developers can be added to the silver halide emulsion layers and/or other photographic layers (e.g., protective layers, interlayers, filter layers, anti-halation layers, backing layers, and the like). They can be added in the form of a solution in a suitable solvent, or in the form of a dispersion, as described in U.S. Pat. No. 2,592,368 and French Patent No. 1,505,778.

The silver halide grains used in this invention can be dispersed into colloids that can be hardened with a variety of organic or inorganic hardeners, such as formaldehyde, chrome alum, 1-hydroxy-3,5-triazine, glyoxal, dichloroacrolein, and the like.

The photographic silver halide emulsions can contain coating aids, for example, saponin, alkylarylsulfonates as described in U.S. Pat. No. 2,600,831; etc., and the amphoteric compounds as described in U.S. Pat. No. 3,133,816.

The photographic silver halide emulsions can also contain antistatic agents, plasticizers, optical brighteners, development accelerators, aerial-fog preventing agents, toners, and the like.

The photographic silver halide emulsions of this invention can contain the so-called non-diffusible couplers, including 4-equivalent diketomethylene yellow couplers and 2-equivalent diketomethylene yellow couplers such as those described in U.S. Pat. Nos. 3,277,154; 3,415,652; 3,447,928; 3,311,476; 3,408,194; 2,875,057; 3,265,506; 3,409,439; 3,511,155; and 3,511,156; Japanese Patent Application (OPI) Nos. 26133/72 and 66836/73; and the like; 2-equivalent or 4-equivalent pyrazolone or imidazolone magenta couplers such as those described in U.S. Pat. Nos. 2,600,788; 2,983,608; 3,006,759; 3,062,653; 3,214,437; 3,253,924; 3,419,391; 3,419,808; 3,476,560 and 3,592,322; Japanese Patent Publication No. 20636/70; Japanese Patent Application (OPI) No. 26133/72; and the like; β-naphthol cyan couplers and phenol cyan couplers such as those described, for example, in U.S. Pat. Nos. 2,474,293; 2,698,794; 3,034,892; 3,214,437; 3,253,924; 3,311,476; 3,458,315 and 3,591,383; Japanese Patent Publication Nos. 11304/67 and 32461/69; and the like; as well as DIR couplers such as those described in U.S. Pat. Nos. 3,227,554; 3,297,445; 3,253,924; 3,311,476; 3,379,529; 3,516,831; 3,617,291 and 3,705,801; German Patent Application (OLS) No. 2,163,811; and the like. The couplers can be employed in the form of dispersions as described in U.S. Pat. No. 2,801,171 and the like.

Examples of anti-irradiation dyes which can be used in this invention include those described, for example, in Japanese Patent Publication Nos. 20389/66; 3,504/68 and 13168/68; U.S. Pat. Nos. 2,697,037; 3,423,207 and 2,865,752; British Patent Nos. 1,030,392 and 1,100,546; and the like.

The silver halide emulsions of the invention can contain, in addition to the combinations in accordance with this invention, other sensitizing dyes, such as those described, for example, in U.S. Pat. Nos. 3,703,377; 2,688,545; 3,397,060; 3,615,635; 3,628,964; 3,615,613; 3,615,632; 3,615,295 and 3,635,721; British Patent Nos. 1,242,588 and 1,293,862; Japanese Patent Publication Nos. 4936/68; 14030/69 and 10773/68; and the like.

The combinations of the dinuclear merocyanine dyes and the compounds of the general formula (II) according to this invention can be used for the sensitization of silver halide emulsions utilized for various color and black-and-white light-sensitive materials. The emulsions which can be used in this invention include those intended for color positives, color papers, color negatives, color reversals (which may, or may not, contain color couplers), photoengraving (e.g., lith films, etc.), cathode-ray tube display materials, X-ray recording materials (particularly those for use in direct or indirect intensifying screen X-ray materials), colloid transfer processes (as described, for example, in U.S. Pat. No. 2,716,059), silver salt diffusion transfer processes (as described, for example, in U.S. Pat. Nos. 2,352,014; 2,543,181; 3,020,155 and 2,861,885), color diffusion transfer processes (as described in U.S. Pat. Nos. 3,087,817; 3,185,567; 2,983,606; 3,253,915; 3,227,550; 3,227,551; 3,227,552; 3,415,644; 3,415,645; 3,415,646, etc.), dye transfer processes (as described in U.S. Pat. No. 2,882,156, etc.), silver dye bleaching processes (as described in Friedman, *History of Color Photography*, American Photographic Publishers Co. (1944), particularly Chapter 24; *British Journal of Photography*, Vol. 111, p.308–309 (Apr. 7, 1964); etc.), print out image recording (as described, for example, in U.S. Pat. No. 2,369,449; Belgian Patent No. 704,255, etc.), direct print out materials (as described, for example, in U.S. Pat. Nos. 3,033,682; 3,287,137; etc.), heat-developable light-sensitive materials (as described, for example, in U.S. Pat. Nos. 3,152,904; 3,312,550 and 3,148,122; British Patent No. 1,110,046; etc.), physical development light-sensitive materials (as described, for example, in British Patent Nos. 920,277 and 1,131,238; etc.), and the like.

The photographic silver halide emulsions of this invention can be coated on a support together with other photographic layers, as necessary. They can be coated using various coating methods, including dip coating, air knife coating, curtain coating, or extrusion coating using a hopper, as described in U.S. Pat. No. 2,681,294. If desired, two or more layers can be coated simultaneously using the methods described in U.S. Pat. Nos. 2,761,791; 3,508,947; 2,941,898; 3,526,528; and the like.

The supports used in this invention include substantially planar materials which have dimensional stability during processing, for example, rigid supports, such as glass, metals and ceramics, and flexible supports. Representative flexible supports include cellulose nitrate film, cellulose acetate film, cellulose acetate butylate film, cellulose acetate propionate film, polystyrene film, poly(ethylene terephthalate) film, polycarbonate film, laminated products thereof, thin glass film, paper, etc., which are ordinarily employed in photographic light-sensitive materials. Satisfactory results can be obtained by using other supports, such as papers coated or laminated with baryta or α-olefin polymers, particularly those polymers obtained from an α-olefin having from 2 to 10 carbon atoms, e.g., polyethylene, polypropylene, ethylene/butene copolymers, etc.; or plastic films with roughened surfaces, which have improved adhesiveness to other polymeric materials, and printing properties, as described in Japanese Patent Publication No. 19068/72. A suitable silver halide coating amount on the support ranges from about 0.2 to 20 g/m², preferably 0.5 to 10 g/m² (as silver).

These supports can be transparent, or can be opaque depending upon the end-use purposes of the light-sensitive materials. The transparent supports can be no only uncolored supports, but also colored support containing dyes or pigments. Such colored support have been utilized in X-ray films, etc., and are described in J. *SMPTE*, Vol. 67, p.296 (1958), etc. Examples of opaque supports which can be used in this invention include, in addition to naturally opaque ones plastic films prepared by adding dyes or pigments, such as titanium oxide, to transparent film-forming materials; surface-treated plastic films treated by the method as described in Japanese Patent Publication No. 19068/72; completely light-shielding papers or plastic films containing carbon black, dyes, etc.; and the like. When the adhesiveness of a support to the photographic emulsion layers is not satisfactory, the support is usually provided with a subbing layer which is adhesive to both the support and a photograhic layer. The surfaces of the supports can be pretreated using a corona discharge, UV-radiation, a flame treatment, etc., in order to further improve the adhesive properties.

The photograhic silver halide emulsions of this invention can be processed in a conventional manner. Examples of developing agents which can be used in this invention include 4-aminophenols represented by 4-N-methyl-aminophenol hemisulfate (Metol), 4-N-benzyl-aminophenol hydrochloride, 4-N,N-dimethylaminophenol hydrochloride, 4-aminophenol sulfate, etc.; 3-pyrazolidones, such as 1-phenyl-3-pyrazolidone, 4,4-dimethyl-1-phenyl-3-pyrazolidone, and 4-methyl-1-phenyl-3-pyrazolidone; polyhydroxybenzenes, such as hydroquinone, 2-methylhydroquinone, 2-phenylhydroquinone, 2-chlorohydroquinone, pyrogallol and catechol; p-phenylenediamines, such as p-phenylenediamine hydrochloride, N,N-diethyl-p-phenylenediamine, etc.; ascorbic acid; N-(p-hydroxyphenyl)glycine; as well as those developers as described in C. E. K. Mees and T. H. James, *The Theory of the Photograhic Process*, 3rd., Chapter 13, MacMillan Co. (1966), and L. F. A. Mason, *Photographic Chemistry*, p.16–30, Oxford Press. These developers can be used individually or in an appropriate combination.

The photograhic silver halide emulsions of this invention can be subjected to color development using primary aromatic amino compounds, such as p-phenylene diamine derivatives. Representative examples of color developers include inorganic acid salts of N,N-diethyl-p-phenylene diamine, 2-amino-5-diethylaminotoluene, 2-amino-5-(N-ethyl-N-laurylamino)toluene, 4-N-ethyl-N-(β-hydroxyethyl)amino aniline, 3-methyl-4-amino-N-ethyl-N-(3-hydroxyethyl)aniline, etc.; 4-amino-3-methyl-N-ethyl-N-(β-methansulfoamidethyl-)aniline sesquisulfate monohydrate, as described in U.S. Pat. No. 2,193,015; N-(2-amino-5-diethylaminophenylethyl)methansulfoamide sulfate, as described in U.S. Pat. No. 2,592,364; N,N-dimethyl-p-phenylenediamine hydrochloride; 3-methyl-4-amino-N-ethyl-N-methoxyethylaniline, as described in Japanese Patent Application (OPI) No. 64933/73; and the like. Detailed descriptions of these color developers appear in L. F. A. Mason, *Photographic Processing Chemistry*, p.226–229, Focal Press, London (1966), and the like. These color developers can also be used together with 3-pyrazolidones.

To the color developing solutions can be added various additives, depending on the requirements. Example of representative additives include alkali agents (e.g., alkali metal or ammonium hydroxides, carbonates, or phosphates); pH adjusting agents or buffers (e.g., weak acids or bases, such as acetic acid and boric acid, or their salts); development accelerators (e.g., pyridium compounds or cationic compounds, such as those described in U.S. Pat. Nos. 2,648,606; 3,671,247; etc.; potassium or sodium nitrate; polyethylene glycol condensation products or their derivatives, such as those described in U.S. Pat. Nos. 2,553,990; 2,577,127; 2,950,970; etc.; nonionic compounds, such as polythioethers of which the compounds as described in British Patent Nos. 1,020,033 and 1,020,033 and 1,020,032 are representative; sulfite ester group-containing polymeric compounds; as well as organic amines, such as pyridine, ethanolamine, etc.; benzyl alcohol; hydrazines; etc.); anti-foggants (e.g., alkali metal bromides; alkali metal iodides; nitrobenzimidazoles, such as those described in U.S. Pat. Nos. 2,496,940 and 2,650,271; mercaptobenzimidazoles; 5-methylbenztriazole; 1-phenyl-5-mercaptotetrazole; those compounds for use in rapid-processing solutions, such as those described in U.S. Pat. Nos. 3,113,864; 3,342,596; 3,295,976; 3,615,522; 3,597,199; etc.; thiosulfonyl compounds, such as those described in British Patent No. 972,211; or phenazine-N-oxides, such as those described in Japanese Patent Publication No. 41650/71; as well as those described in *Kagaku Shashin Binran* (*Handbook of Scientific Photography*), Vol. 2, p.29–47); stain- or sludge-preventing agents (such as those described in U.S. Pat. Nos. 3,161,513 and 3,161,514; and British Patent Nos. 1,030,442; 1,144,481 and 1,251,558); inter-layer effects accelerators (such as those described in U.s. Pat. No. 3,536,487; etc.); preservatives (e.g., sulfites, bisulfites, hydroxylamine hydrochlorides, formfulsite, alkanolamine sulfite adducts, etc.); and the like.

The photograhic silver halide emulsions of this invention can be fixed in a convential manner, or can in some cases (e.g., where the color photographic light-sensitive material contains a colored coupler) be bleached. The bleaching can be effected at the same time as, or separately from the fixing. When the bleaching and fixing are carried out simultaneously, a blix solution containing both a bleaching agent and a fixing agent can be employed. A variety of compounds can be used as a bleaching agent, such as ferricyanides; bichromates; water-soluble cobalt(III) salts; water-soluble copper(II) salts; water-soluble quinones; nitrosophenols; polyvalent metal compounds containing iron(III), cobalt(III), copper(II), etc., particularly the complex salts of these polyvalent metal cations with organic acids, e.g., metal complexes of amino polycarboxylic acids such as ethylenediaminetetraacetic acid, nitrilotriacetic acid, iminodiacetic acid and N-hydroxyethylethylenediaminetriacetic acid, malonic acid, tartaric acid, malic acid, diglycolic acid, dithioglycolic acid, etc., 2,6-dipicolinic acid-copper complex, and the like; peroxides, e.g., alkyl peracids, persulfonates, permanganates, hydrogen peroxide, etc.; hypochlorites, e.g., chlorine, bromine, etc. These compounds can be used individually or in combination.

The details of bleaching, fixing, or bleach-fixing are described in U.S. Pat. No. 3,582,322 and the like. These solutions can contain various additives, including bleaching promoters such as those described in U.S. Pat. Nos. 3,042,520 and 3,241,966; Japanese Patent Publication Nos. 8506/70 and 8836/70; and the like.

Dinuclear merocyanine dyes, particularly merodicarbocyanine dyes have drawbacks in that, when they are incorporated singly in a silver halide emulsion, the dye fog formation tends to occur and the spectral sensitivity conferred by the sensitizing dye tends to be reduced with the lapse of time. The compounds of the general formula (II) have substantially no spectral absorption in the visible range, but have a strong absorption in the near ultraviolet region. However, when a dinuclear merocyanine dye is incorporated in an emulsion in combination with a compound of the general formula (II), the production of dye fog can be effectively inhibited without substantially reducing the spectral sensitivity, and the reduction in spectral sensitivity during storage can be prevented markedly. Of the compounds of the general formula (II), those in which at least one of $R_2$, $R_3$, $R_4$, and $R_5$ is a member selected from the group consisting of an aryloxy group, a heterocyclic thio group, and a heterocyclic amino group are particularly effective for the prevention of marked dye fog and deterioration of spectral sensitivity during storage which are caused particularly by merodicarbocyanine dyes. Conventional anti-foggants or stabilizers used for the prevention of dye fog formed in emulsions containing dinuclear merocyanine dye alone are usually accompanied by a reduction of sensitivity and contrast along with a reduction of fog. It is surprising that the use of the compound represented by general formula (II) causes no reduction in contrast and, in some case, rather increases the contrast along with the reduction of fog. Usually, the compounds of general formula (II), which are used for preventing fog due to dinuclear merocyanine dyes, do not reduce spectral sensitivity or only slightly reduce the spectral sensitivity, if at all.

In cases of photograhic materials, such as color photographic materials, which contain at least two layers spectrally sensitive to different light-sensitive wavelength ranges, the diffusion of a dye of another layer causes an undesirable sensitization in the layer containing the diffused dye (diffusion sensitization) due to the diffused dye, the prevention of which is important from a technical point of view. Although dinuclear merocyanine dyes, particularly those having an alkyl group containing a sulfo group, or an alkyl group containing a carboxyl group as a substituent, have the advantage that in the presence of a color coupler the sensitivity is reduced only slightly, they tend to diffuse and cause greater diffusion sensitization. On the other hand, it has been surprisingly found that, when merocyanine dyes are used for spectral sensitization together with a compound of the general formula (II), such diffusion sensitization can be prevented.

Further, the combined use of a merocyanine dye with a compound of the general formula (II) has the advantage that staining due to color development can be prevented.

The photographic materials of this invention have the advantage that inhibition of spectral sensitization caused by color couplers also present is prevented by the combinations of this invention.

The following examples are given to illustrate the invention in greater detail. Unless otherwise indicatd herein all parts, percents, ratios and the like are by weight.

EXAMPLE 1

A definite amount of a $5 \times 10^{-4}$ mol/liter methanol solution of sensitizing dye was added to 100 g of a silver chlorobromide emulsion (Cl, 30 mol%; Br, 70 mol%; Ag, $4.92 \times 10^{-2}$ mol; gelatin 7 g) and a definite amount of a 0.5 percent methanol solution of the compound represented by general formula (II) (when the solubility of the compound was insufficient, 0.1 ml of aqueous 1N NaOH solution was added per 20 ml of methanol to dissolve the compound) was immediately added to the resulting solution. The mixture was stirred for 1 hour at 40° C and then applied to a cellulose triacetate film base in a thickness of about 5 $\mu$ (dried thickness). The sample was exposed using an optical wedge through a blue filter transmitting only light of wavelengths shorter than 500 nm and a yellow filter transmitting only light having wavelengths longer than 500 nm, and then developed for 10 minutes at 20° C. in a developer having the composition shown below, followed by fixing, washing, and drying.

| | |
|---|---|
| Monomethyl-p-aminophenol ½ sulfate | 0.3 g |
| Potassium Pyrosulfite | 1.4 g |
| Sodium Sulfite (anhydrous) | 38.0 g |
| Hydroquinone | 6.0 g |
| Sodium Carbonate (monohydrate) | 22.5 g |
| Potassium Bromide | 0.9 g |
| Citric Acid | 0.7 g |
| Water to make | 1 liter |

The density of the sample was measured using a densitometer Model P made by the Fuji Photo Film Cl., LTD. The results obtained are shown in Table 1.

Table 1

| | Sensitizing Dye | | General Formula (II) Compound | | Relative Sensitivity | | |
|---|---|---|---|---|---|---|---|
| No. | No. | Amount (ml) | No. | Amount (ml) | Blue Sensitivity | Yellow Sensitivity | Fog |
| 1 | 5 | 4.0 | 1 | — | 100 | 100 | 0.12 |
| | | 8.0 | | — | 90 | 95 | 0.14 |
| | | 4.0 | | 2.0 | 100 | 100 | 0.10 |
| | | 4.0 | | 4.0 | 100 | 95 | 0.08 |
| 2 | 7 | 4.0 | 2 | — | 100 | 100 | 0.11 |
| | | 8.0 | | — | 95 | 100 | 0.12 |
| | | 4.0 | | 2.0 | 100 | 100 | 0.08 |
| | | 4.0 | | 4.0 | 100 | 100 | 0.08 |
| 3 | 9 | 4.0 | 3 | — | 100 | 100 | 0.12 |
| | | 8.0 | | — | 90 | 90 | 0.15 |
| | | 4.0 | | 2.0 | 105 | 95 | 0.10 |
| | | 4.0 | | 4.0 | 100 | 95 | 0.08 |
| 4 | 11 | 4.0 | 4 | — | 100 | 100 | 0.14 |
| | | 8.0 | | — | 95 | 100 | 0.17 |
| | | 4.0 | | 2.0 | 100 | 100 | 0.10 |
| | | 4.0 | | 4.0 | 100 | 90 | 0.09 |
| 5 | 14 | 4.0 | 1 | — | 100 | 100 | 0.20 |
| | | 8.0 | | — | 90 | 85 | 0.28 |
| | | 4.0 | | 2.0 | 105 | 100 | 0.14 |
| | | 4.0 | | 4.0 | 100 | 93 | 0.11 |
| 6 | 15 | 4.0 | 1 | — | 100 | 100 | 0.15 |
| | | 8.0 | | — | 87 | 83 | 0.18 |
| | | 4.0 | | 2.0 | 105 | 105 | 0.11 |
| | | 4.0 | | 4.0 | 100 | 100 | 0.09 |
| 7 | 20 | 4.0 | 1 | — | 100 | 100 | 0.14 |
| | | 8.0 | | — | 93 | 93 | 0.18 |

Table 1-continued

| No. | Sensitizing Dye No. | Sensitizing Dye Amount (ml) | General Formula (II) Compound No. | General Formula (II) Compound Amount (ml) | Relative Sensitivity Blue Sensitivity | Relative Sensitivity Yellow Sensitivity | Fog |
|---|---|---|---|---|---|---|---|
| | | 4.0 | | 2.0 | 102 | 105 | 0.12 |
| | | 8.0 | | 4.0 | 100 | 100 | 0.09 |

From the results in Table 1 above, it can be understood that the formation of fog is markedly reduced in the cases of the emulsions of this invention.

EXAMPLE 2

Coatings were made as in Example 1, except that 100 g of a gelatino-silver chlorobromide emulsion (CL, 40 mol%; Br, 60 mol%; Ag, $4.92 \times 10^{-2}$ mol; gelatin, 7 g) was employed.

The coatings were exposed through a yellow filter and developed for 4 minutes at 20° C in a developing solution having the composition shown below. The photographic properties of the coatings were measured in a similar manner to Example 1. The results obtained are shown in Table 2.

| | |
|---|---|
| Monomethyl-p-aminophenol ½ Sulfate | 2.0 g |
| Hydroquinone | 8.0 g |
| Sodium Sulfite (anhydrous) | 90.0 g |
| Sodium Carbonate (monohydrate) | 52.5 g |
| Potassium Bromide | 5.0 g |
| Water to make | 1 liter |

Table 2

| No. | Sensitizing Dye No. | Sensitizing Dye Amount | General Formula (II) Compound or Comparison Compound | Relative Sensitivity to Yellow Light | Gamma | Fog |
|---|---|---|---|---|---|---|
| 8 | 17 | 4.0 | — | 100 | 5.0 | 0.04 |
| | | 4.0 | 6 | 159 | 6.0 | 0.03 |
| | | 4.0 | 6 | 159 | 5.5 | 0.03 |
| | | 4.0 | A* | 155 | 4.2 | 0.04 |
| | | 4.0 | A | 151 | 4.0 | 0.04 |
| 9 | 18 | 4.0 | — | 100 | 4.8 | 0.04 |
| | | 4.0 | 7 | 151 | 6.0 | 0.03 |
| | | 4.0 | 7 | 148 | 5.8 | 0.03 |
| | | 4.0 | A | 125 | 4.0 | 0.04 |
| | | 4.0 | A | 120 | 4.0 | 0.04 |
| 10 | 19 | 4.0 | — | 100 | 4.5 | 0.04 |
| | | 4.0 | 8 | 123 | 5.5 | 0.03 |
| | | 4.0 | 8 | 121 | 5.5 | 0.03 |
| | | 4.0 | A | 110 | 3.8 | 0.04 |
| | | 4.0 | A | 115 | 3.7 | 0.04 |
| 11 | 20 | 8.0 | — | 100 | 4.8 | 0.04 |
| | | 8.0 | 9 | 155 | 5.0 | 0.03 |
| | | 8.0 | 9 | 151 | 5.1 | 0.03 |
| | | 8.0 | A | 142 | 4.0 | 0.04 |
| | | 8.0 | A | 139 | 3.8 | 0.04 |
| 12 | 21 | 8.0 | — | 100 | 5.0 | 0.04 |
| | | 8.0 | 11 | 166 | 5.8 | 0.03 |
| | | 8.0 | 11 | 163 | 5.6 | 0.03 |
| | | 8.0 | A | 151 | 4.2 | 0.04 |
| | | 8.0 | A | 151 | 4.2 | 0.04 |
| 13 | 22 | 8.0 | — | 100 | 4.3 | 0.05 |
| | | 8.0 | 2 | 200 | 4.6 | 0.03 |
| | | 8.0 | 2 | 200 | 4.4 | 0.03 |
| | | 8.0 | A | 178 | 3.6 | 0.05 |
| | | 8.0 | A | 174 | 3.5 | 0.05 |
| 14 | 23 | 2.0 | — | 100 | 4.8 | 0.05 |
| | | 2.0 | 3 | 105 | 6.2 | 0.03 |
| | | 2.0 | 3 | 100 | 6.0 | 0.03 |
| | | 2.0 | A | 100 | 4.3 | 0.05 |
| | | 2.0 | A | 93 | 4.0 | 0.05 |
| 15 | 24 | 2.0 | — | 100 | 3.2 | 0.10 |
| | | 2.0 | 6 | 200 | 4.5 | 0.05 |
| | | 2.0 | 6 | 178 | 4.3 | 0.04 |
| | | 2.0 | A | 126 | 3.0 | 0.10 |
| | | 2.0 | A | 121 | 2.8 | 0.10 |
| 16 | 25 | 2.0 | — | 100 | 4.5 | 0.04 |
| | | 2.0 | 6 | 210 | 5.5 | 0.04 |
| | | 2.0 | 6 | 200 | 5.0 | 0.03 |
| | | 2.0 | A | 200 | 3.2 | 0.04 |
| | | 2.0 | A | 187 | 3.0 | 0.04 |
| 17 | 26 | 2.0 | — | 100 | 4.0 | 0.04 |
| | | 2.0 | 6 | 105 | 4.8 | 0.03 |
| | | 2.0 | 6 | 100 | 4.2 | 0.03 |
| | | 2.0 | A | 100 | 4.2 | 0.03 |
| | | 2.0 | A | 95 | 2.4 | 0.04 |
| 18 | 27 | 2.0 | — | 100 | 4.2 | 0.04 |
| | | 2.0 | 6 | 121 | 5.2 | 0.03 |
| | | 2.0 | 6 | 118 | 5.2 | 0.03 |
| | | 2.0 | A | 107 | 4.2 | 0.04 |
| | | 2.0 | A | 105 | 4.0 | 0.04 |
| 19 | 0.042.0 | — | 100 | 4.0 | 0.04 | |
| | | 2.0 | 6 | 152 | 5.2 | 0.03 |
| | | 2.0 | 6 | 148 | 5.0 | 0.03 |

Table 2-continued

| No. | Sensitizing Dye No. | Sensitizing Dye Amount | General Formula (II) Compound or Comparison Compound | Relative Sensitivity to Yellow Light | Gamma | Fog |
|---|---|---|---|---|---|---|
| | | 2.0 | A | 145 | 4.0 | 0.04 |
| | | 2.0 | A | 142 | 3.7 | 0.04 |
| 20 | 29 | 2.0 | — | 100 | 4.2 | 0.04 |
| | | 2.0 | 6 | 107 | 4.5 | 0.03 |
| | | 2.0 | 6 | 107 | 4.5 | 0.03 |
| | | 2.0 | A | 105 | 3.0 | 0.04 |
| | | 2.0 | A | 100 | 2.5 | 0.04 |
| 21 | 30 | 2.0 | — | 100 | 4.0 | 0.04 |
| | | 2.0 | 6 | 112 | 4.8 | 0.03 |
| | | 2.0 | 6 | 110 | 4.5 | 0.03 |
| | | 2.0 | A | 105 | 3.2 | 0.04 |
| | | 2.0 | A | 102 | 3.0 | 0.04 |

*Compound A = Leucophor B (a triazine compound)

The results in the above Table 2 show:

1. The merodicarbocyanine dyes, when used together with a compound represented by general formula (II), increase the spectral sensitivity in a certain concentration range (about from $2 \times 10^{-5}$ to about $2 \times 10^{-3}$ mole of dye per mole of silver halide), the spectral sensitivity being greater than that of the control compound A;

2. The combinations of this invention increase the gamma while the combinations of the control compound A with a dye tend to decrease the gamma; and 3. The compounds of general formula (II) in this invention reduce dye fog while the control compound A does not reduce dye fog. Although the absolute values of the reduction in fog are small (e.g., 0.01), in cases of color papers, black-and-white papers and the like, the human eye can detect a marked difference even with such a small reduction.

EXAMPLE 3

Onto a polyethylene coated photographic paper were coated, in succession, (1) a blue-sensitive silver chlorobromide (Br 90 mol%; Cl 10 mol%) emulsion layer containing a yellow dye-image forming coupler, α-(4-palmitamidophenoxy-α-pivaloyl-4-sulfoamylacetanilide (as disclosed in U.S. Pat. No. 3,408,194), and 2-n-octadecyl-5-(2-sulfo-tert-butyl)hydroquinone potassium salt (a commonly used anti-staining agent); (2) a gelation interlayer containing dioctylhydroquinone (a commonly used anti-staining agent); (3) a green-sensitive silver chlorobromide (Br 70 mol%; Cl 30 mol%) emulsion containing magenta dye-image forming coupler, 1-phenyl-3-methyl-4-(4-methylsulfophenoxy)-5-pyrazolone (as disclosed in British Patent No. 1,140,898) dispersed in tricresyl phosphate (a commonly used solvent), dioctylhydroquinone, and a green-light absorbing dye; (4) a gelatin layer containing dioctylhydroquinone dispersed in tricresyl phosphate; and (5) a red-sensitive silver chlorobromide (Br 70 mol%, Cl 30 mol%) emulsion layer containing a cyan dye-image forming coupler 1-hydroxy-4-maleimide-2-naphthamide (as disclosed in British Patent No. 1,165,565) dispersed in dibutyl phthalate (a commonly used solvent), dioctylhydroquinone and a red-light absorbing dye, as well as a definite amount of the sensitizing dye and the compound of the general formula (II) shown in Table 3.

The multilayered materials were exposed using an optical wedge through a blue filter, a green filter and a red filter, and then subjected to the color paper processing described below.

The measurement of density was conducted by using a densitometer Model P made by the Fuji Photo Film Co., Ltd.

The density of the areas exposed through a red filter was measured, in addition to the usual measurement with a blue filter, by using a blue filter in order to examine diffusion sensitization.

The results obtained are shown in Table 3.

| Processing Steps | Temperature (°C) | Time (minutes) |
|---|---|---|
| Color Development | 30 | 6 |
| Stopping | 30 | 2 |
| Washing | 30 | 2 |
| Blixing | 30 | 1.5 |
| Washing | 30 | 2 |
| Stabilizing | 30 | 2 |
| Drying | | |

Each processing solution had the following composition:

| | |
|---|---|
| Color Developing Solution | |
| Benzyl Alcohol | 12 ml |
| Diethylene Glycol | 3.5 ml |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfite | 2.0 g |
| Disodium Ethylenediamine-tetraacetate (dihydrate) | 2.0 g |
| 4-Amino-3-methyl-N-ethyl-N-(β-methansulfonamidethyl)-sesquisulfate Monohydrate | 5.0 g |
| Water to make | 1 liter |
| Stopping Solution | |
| Sodium Thiosulfate | 10 g |
| Ammonium Thiosulfate (70% aq. soln.) | 30 cc |
| Sodium Acetate | 5 g |
| Acetic Acid | 30 cc |
| Potassium Alum | 15 g |
| Water to make | 1 liter |
| Bleach-Fixing Solution | |
| Ferric Sulfate | 20 g |
| Disodium Ethylenediamine-tetraacetate (dihydrate) | 36 g |
| Sodium Carbonate (monohydrate) | 17 g |
| Sodium Sulfite | 5 g |
| Ammonium Thiosulfate (70% aq. soln.) | 100 g |
| Boric Acid | 5 g |
| Water to make | 1 liter (pH = 6.8) |
| Stabilizing Solution | |
| Boric Acid | 5 g |
| Sodium Citrate | 5 g |
| Sodium Metaborate (tetrahydrate) | 3 g |
| Potassium Alum | 15 g |

-continued

| Water to make | 1 liter |
|---|---|

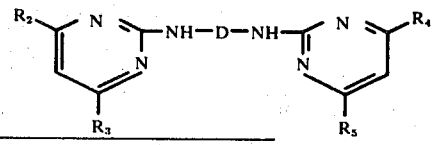

(II)

Table 3

| Sensitizing Dye | | General Formula (II) Compound | | Relative Sensitivity | | | | |
|---|---|---|---|---|---|---|---|---|
| | | | | Initial | | | | After[6] Four Months |
| | | | | Red[3] | | Green[3] | Blue[3] | Red[3] |
| No. | Amount[1] | No. | Amount[2] | Red[4] | Blue[4,5] | Green[4] | Blue[4] | Red[4] |
| 30 | 2.0 | — | — | 100 | 2.5 | 100 | 100 | 85 |
| | 2.0 | 6 | 7.5 | 100 | 1.0 | 100 | 110 | 97 |
| | 2.0 | 6 | 10.0 | 95 | 0.7 | 100 | 110 | 95 |
| 26 | 2.0 | — | — | 100 | 1.0 | 100 | 100 | 80 |
| | 2.0 | 1 | 7.5 | 100 | 0.3 | 100 | 105 | 97 |
| | 2.0 | 1 | 10.0 | 100 | 0.2 | 100 | 110 | 97 |

Notes:
[1]Amount added: cc/100 g of emulsion ($5 \times 10^{-4}$ mol/liter)
[2]Amount added: cc/100 g of emulsion (0.5 wt%)
[3]Filter used for exposure
[4]Filter used for the measurement of density
[5]Diffusion sensitization
[6]Stored at 25° C (±2° C), 65–70% R.H.

The results in Table 3 show:

1. The diffusion sensitization in the materials not containing the compound represented by general formula (II) ranges from about 2.5 to 5 times that of the materials containing the compound represented by the general formula (II); and 2. The addition of the compound represented by general formula (II) reduces the decrease of sensitivity during storage.

While the invention has been described in detail and with reference to specific embodiments thereof, it will be apparent to one skilled in the art that various changes and modifications can be made therein without departing from the spirit and scope thereof.

What is claimed is:

1. A photographic silver halide emulsion containing at least one dinuclear merocyanine dye represented by the formula (Ia):

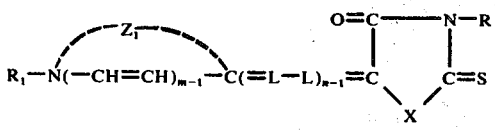

(Ia)

wherein R and $R_1$, which may be the same or different, each represents an aliphatic group; $Z_1$ represents the nonmetallic atoms required to form a 5- or 6-membered heterocyclic nucleus selected from the group consisting of a thiazole nucleus, a thiazoline nucleus, an oxazole nucleus, a selenazole nucleus, a 3,3'-dialkylindolenine nucleus, an imidazole nucleus, a tetrazole nucleus, a pyridine nucleus and a quinoline nucleus; X represents a sulfur atom, an oxygen atom or a N—R' wherein R' represents an alkyl group or an aryl group; L represents a methine group; m represents 1 or 2; and n represents 1, 2, or 3, and at least one compound of the formula (II):

wherein D represents a divalent aromatic group, $R_2$, $R_3$, $R_4$, and $R_5$, which may be the same or different, each represents a hydrogen atom, a hydroxy group, an alkoxy group, an aryloxy group, a halogen atom, a heterocyclic group, a mercapto group, an alkylthio group, an arylthio group, a heterocyclic thio group, an amino group, an alkylamino group, a cycloalkylamino group, an arylamino group, a heterocyclic amino group, an aralkylamino group, or an aryl group.

2. The photographic silver halide emulsion as claimed in claim 1, wherein said dinuclear merocyanine dye is represented by the formula (Ib):

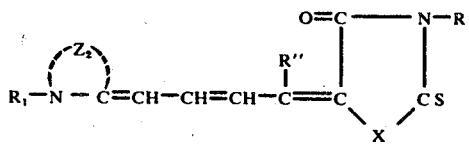

(Ib)

wherein R and $R_1$, which may be the same or different, each represents an aliphatic group; R'' represents a hydrogen atom, an alkyl group, or an aryl group; X represents a sulfur atom, an oxygen atom, or a >N>R' group, wherein R' represents an alkyl group, or an aryl group; $Z_2$ represents the nonmetallic atoms required to a thiazole nucleus or a selenazole nucleus.

3. The photographic silver halide emulsion as claimed in claim 1, wherein said dinuclear merocyanine dye is a compound selected from the group consisting of 3-ethyl-5-[4-(3-ethyl-2-benzothiazolinylidene)-2-butenylidene]rhodanine, 3-ethyl-5-[4-(3-ethyl-2-benzothiazolinylidene)-3-methyl-2-butenylidene]rhodanine, 3-phenyl-1-carboxymethyl-5-[(ethylnaphtho[2,3-d]thiazolin-2-ylidene)-1-phenyl-2-butenylidene]-2-thiohydantoin, 1,3-diethyl-5{[3-(3-sulfopropyl)naphtho[2,3-d]thiazolin-2-ylidene]-1-phenyl-2-butenylidene}-2-thiohydantoin sodium salt, 3-ethyl-5-{[3-(3-sulfopropyl)naphtho[2,3-d]thiazolin-2-ylidene]-1-ethyl-2-butenylidene}rhodanine sodium salt, and 3-(2-sulfoethyl)-5-[(3-ethylnaphtho [2,3-d]thiazolin-2-ylidene)-1-methyl-2-butenylidene]rhodanine.

4. The photographic silver halide emulsion as claimed in claim 1, wherein at least one of $R_2$, $R_3$, $R_4$, and $R_5$ is an aryloxy group, a heterocyclic thio group, or a heterocyclic amino group.

5. The photographic silver halide emulsion as claimed in claim 1, wherein said compound of the formula (II) is a compound selected from the group consisting of sodium 4,4′-bis[4,6-di(benzothiazoyl-2-thio)-pyrimidin-2-ylamino]stilbene-2,2′-disulfonate, sodium 4,4′-bis[4,6-di(benzothiazoyl-2-amino)pyrimidin-2-ylamino]stilbene-2,2′-disulfonate, disodium 4,4′-bis[4,6-di(benzoimidazolyl-2-thio)pyrimidin-2-ylamino]stilbene-2,2′-disulfonate, disodium 4,4′-bis[4,6-di(naphthyl-2-oxy)pyrimidin-2-ylamino]stilbene-2,2′-disulfonate, disodium 4,4′-bis[4,6-di(naphthyl-2-oxy)pyrimidin-2-ylamino]dibenzyl-2,2′-disulfonate, and disodium 4,4′-bis(4,6-diphenoxypyrimidin-2-ylamino)stilbene-2,2′-disulfonate.

6. The photographic silver halide emulsion as claimed in claim 1, wherein the dinuclear merocyanine dye is present in an amount of about $2 \times 10^{-5}$ to $2 \times 10^{-3}$ mole per mole of the silver halide.

7. The photographic silver halide emulsion as claimed in claim 1, wherein the compound of the formula (II) is present in an amount of about 0.01 to 5 g per mole of the silver halide.

8. A photographic light-sensitive material comprising a support having thereon at least one silver halide emulsion layer as claimed in claim 1.

9. A color photographic light-sensitive material comprising a support having thereon at least two silver halide emulsion layers according to claim 1, with at least one of side silver halide emulsion layers containing a color coupler.

* * * * *